United States Patent [19]

Brown, Jr.

[11] 4,305,726

[45] Dec. 15, 1981

[54] METHOD OF TREATING COAL TO REMOVE SULFUR AND ASH

[76] Inventor: George E. Brown, Jr., 4003 Sharon Park La., Cincinnati, Ohio 45241

[21] Appl. No.: 106,278

[22] Filed: Dec. 21, 1979

[51] Int. Cl.[3] ..... C10L 9/02

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 200,663 | 11/1878 | Morey | 44/1 SR |
| 1,899,808 | 2/1933 | Kern | 201/17 X |
| 2,346,151 | 4/1944 | Burk et al. | 44/1 R |
| 3,640,016 | 2/1972 | Lee et al. | 44/1 SR |
| 3,926,575 | 12/1975 | Meyers | 44/1 SR |
| 3,998,604 | 12/1976 | Hinkley | 44/1 R |
| 4,071,328 | 1/1978 | Sinke | 44/1 SR |
| 4,134,737 | 1/1979 | Yang | 44/1 SR |

*Primary Examiner*—Carl F. Dees

*Attorney, Agent, or Firm*—Wood, Herron & Evans

[57] ABSTRACT

The present invention is directed to an improved method of chemically treating coal to remove sulfur and ash. It is especially adapted for use on high sulfur, refuse coal. In practice the coal is treated with hydrochloric acid and hypochlorous acid in the presence of ferric and ferrous sulfate to convert the iron pyrites to other sulfur compounds. These are then converted to various salts of calcium through neutralization with lime.

11 Claims, No Drawings

METHOD OF TREATING COAL TO REMOVE SULFUR AND ASH

BACKGROUND OF THE INVENTION

There exists in the United States a large quantity of coal which cannot be economically used as a fuel because of its high sulfur content. Environmental laws are such that it is economically unfeasible to burn a high sulfur content coal because of the expensive antipollution equipment required.

High sulfur coal, i.e., about 3%, exists in unmined form and also in the form of already mined coal that has been discarded, i.e., refuse coal. Refuse coal usually consists of fines which result from the processing of coal. More particularly, when coal is mined it is normally crushed and washed and the washings are generally dumped and used as land fill or dumped into a lake or stream. In the latter case, over a period of time, the pond or stream becomes almost completely filled with the finely powdered coal. Not only is this a significant waste of coal but it is injurious to the lakes and streams. Many lakes have become "dead" lakes due to this disposal of waste coal. The ash content of such refuse coal, i.e., above 20% by weight, also makes it economically unattractive to attempt to utilize it.

There also exist in the United States substantial deposits of unmined or virgin coal having a high sulfur content. In order to burn such coal in industry it would be necessary to spend substantial amounts of money for air pollution equipment. Therefore, this high sulfur content coal is not being mined.

The need to effectively utilize energy while at the same time protecting our environment faces many other industries as well, the steel industry being another example. The disposal of waste materials from steel making processes in an economically feasible, environmentally suitable manner is frequently a significant problem. For example, in the processing of steel an acid solution (pickle liquor) is used to treat the product. The resultant solution consisting of acid, iron compounds, contaminants, etc. (collectively referred to hereinafter as spent pickle liquor) must be disposed of.

SUMMARY OF THE INVENTION

The present invention is applicable to high sulfur, high ash refuse or virgin coal. In one form of the present process, coal, crushed to about ¼ by 0 size is first treated with spent pickle liquor. Thereafer it is subjected to a strong acidic oxidizing agent. More particularly, the acidified coal mixture is treated with a mixture of chlorine gas dissolved in water. Thereafter coal and ash are separated through the use of water and gravity. Following this, the acid solution remaining is treated with lime and the precipitate which contains various sulfur compounds is discarded. These sulfur compounds exist in such a state that they are not injurious to our environment when discarded and in fact have a beneficial effect on dead lakes. In an alternative form of the present invention only a minor amount of water is added to the pulverized coal, preferably in the form of steam, and the mixture is treated with chlorine gas.

DESCRIPTION OF THE PREFERRED EMBODIMENT

The process of this invention can be effectively practiced on any high sulfur content coal. In its most useful application it is practiced on refuse coal that at the present time has no utility. After treatment the refuse coal contains less than about 1% sulfur, has about 5–6% ash, has about 14,000–14,500 btu per pound, and is processed into easily handled pellets. In contrast, before processing the refuse coal typically contains 2–3% sulfur, 25–30% ash and has a btu content of only 7,500.

Refuse coal is produced as the result of normal coal mining operations and exists as a result of coal being crushed and washed. Typically it is ¼ by 0, that is ¼ inch down to 325 mesh in size. Typically it is discarded as land fill or thrown into a pond, lake or stream. In some instances as much as 20% by weight of the mined coal ends up in the form of heretofore unusable refuse coal.

Various areas of the United States contain large deposits of coal which are basically unusable because of the high sulfur content of the coal. The present process is applicable also to such coal. The only modification required is to pulverize the coal so that it is about ¼ by 0 as in the case of refuse coal.

In the practice of the process the pulverized coal is first mixed with spent pickle liquor. In the manufacture of iron or steel it is customary to use a pickling acid to remove scale, rust, etc. Most frequently 60° Be' sulfuric acid is employed and this is the preferred form for use in the present invention although other acid pickle liquors may be employed. After use, the spent pickle liquor comprising the acid and various iron compounds such as $Fe_2(SO_4)_3$, $FeSO_4.7H_2O$ and other contaminants must be disposed of. Obviously, the disposal of such a liquid poses a significant problem from an environmental standpoint.

For some unknown reason the use of spent pickle liquor produces superior results than if the acid itself is used. While it is not completely understood, it is believed that the iron salts present in the spent pickle liquor have a significant effect on the reaction rate.

If only uncontaminated $H_2SO_4$ is used, the final results in many cases in terms of sulfur removal are inferior and the speed of the reaction is decreased. Moreover, the ability to convert a material that poses such an environmental risk to a safe, useful material able to benefit the environment is an advantage not to be taken lightly. While it is preferred to use spent pickle liquor the acid in unused form may be utilized recognizing, of course, that under some conditions inferior results may be obtained.

The amount of spent pickle liquor mixed with the pulverized coal is somewhat dependent on the sulfur content of the coal. Usually though 2% pickle liquor based on the weight of the coal is sufficient.

It is important to allow the pickle liquor to contact the coal for a brief period of time prior to further processing. In practice 5–10 minutes has been found to be satisfactory. Thereafter, the mixture is introduced into any suitable type of reactor mixer and mixed with about 20% by weight of water. Preferably the water temperature and temperature of the mixture is 80°–90° F. This may require suitable heating or cooling means of conventional design. Into the reactor mixer is introduced chlorine gas. The amount of chlorine required is an amount sufficient to provide a mixture having a pH of about 3 or less. When mixed with the water the chlorine gas provides hydrochloric acid, hypochlorous acid and nascent oxygen.

While it is not completely understood, it is believed that the iron disulphide (iron pyrite) which is present in the coal and which forms the major sulfur containing material is converted into the following iron and sulfur compounds through the following reactions:

$$FeS_2+2HOCl \rightarrow FeS+2HCl+SO_2$$

$$FeS+2HCl \rightarrow FeCl_2+H_2S$$

$$H_2S+2HOCl \rightarrow SO_2+2HCl$$

$$SO_2+H_2O \rightarrow H_2SO_3$$

$$H_2SO_3+HOCl \rightarrow H_2SO_4+HCl$$

After the reaction is essentially complete, the ash and coal that are present can be mechanically separated from each other and from the acid solution. One convenient way for doing so consists of introducing the entire mixture into a conically shaped separator of conventional design, where provision is made at the bottom for introducing water. At the top a wier is provided such that material at the surface of the mixture will be transferred out of the separator and into a discharge conduit. The denser, heavier coal particles fall to the bottom and are discharged though an outlet. The coal is then dried and preferably pelletized.

To the liquid and water material overflowing the separation is added a sufficient amount of lime to precipitate most of the sulfur as calcium salts, i.e., $CaSO_3$, CaS, $CaSO_4$ or other salts of calcium containing sulfur. The amount of lime required is that amount which is required to provide a neutral or nearly neutral pH. Such precipitated salts are thereafter separated and preferably used as fill in coal slurry ponds. If the ponds are not totally filled but if a sufficient amount of the precipitate is added over a relatively short period of time the pond is once again capable of supporting life.

The coal so recovered has less than 6% ash, less than 1% sulfur and a btu content of about 14,000 per pound. The economics of the process are such that refuse coal may be economically reclaimed to provide an excellent energy source.

In the alternative form of the present invention, to the pulverized coal is added a minor amount of water, preferably in the form of steam. The water added is preferably an amount equal to about 10–20% by weight of the coal. Thereafter, to the mixture is added chlorine gas. Unlike the previous embodiment the cholorine gas is not dissolved in water nor is pickle liquor added to the mixture. Also, the amount of water required is reduced. As in the previous embodiment, the mixture after treatment with the chlorine gas is subjected to the separation step and thereafter to the neutralization step.

Having thus described my invention, I claim:

1. A method of treating pulverized coal to remove sulfur comprising:

adding spent sulfuric acid pickle liquor to said coal, adding to said coal a mixture of water with chlorine gas added thereto, the amount of pickle liquor and chlorine gas being an amount sufficient to provide a mixture having a pH of less than about 3, and physically separating said coal from said mixture.

2. The method of claim 1 wherein the mixture remaining after the coal has been removed is neutralized so as to provide a precipitate comprising in substantial part inorganic sulfates.

3. The method of claim 1 wherein a substantial amount of ash is physically separated from the mixture simultaneously with the separation of the coal from the mixture.

4. The method of claim 3 wherein the mixture remaining after the removal of the coal and ash fractions is neutralized so as to provide a precipitate comprising in substantial part inorganic sulfates.

5. The method of claim 2 or claim 4 wherein lime is used as the neutralizing agent.

6. The method of claim 5 wherein the precipitate is used to treat dead bodies of water.

7. The method of claim 3 wherein the coal and ash are separated from the mixture through the use of a water flow.

8. The method of claim 7 wherein the coal is refuse coal.

9. A process for removing ash and sulfur from coal wherein sulfur is present consisting essentially of the following steps:

(a) forming a coal and water mixture, (b) treating the mixture with an acidic oxidizing agent so as to convert the sulfur to a sulfur containing acid(s), said oxidizing agent comprising HCL, HOCL and nascent oxygen formed through the addition of $CL_2$ to water, the amount of $CL_2$ being an amount sufficient to convert the sulfur to a sulfur containing acid(s), (c) physically separating any ash from the mixture, (d) treating the remaining coal mixture containing the sulfur containing acid(s) with lime whereby the sulfur is precipitated as calcium salts, and (e) physically separating the calcium salts from the coal.

10. The method of claim 9 wherein the coal to be treated is refuse coal and the coal after treatment has less than 6% ash, less than about 1% sulfur and a BTU content of about 14,000 per pound.

11. The method of claim 9 wherein the amount of water is about 10–20% by weight of the coal.

* * * * *